US005645111A

United States Patent [19]

Lindblom

[11] Patent Number: 5,645,111

[45] Date of Patent: Jul. 8, 1997

[54] DEVICE FOR CONTROLLING OPERATIONS OF SHAFT FRAMES OF A WEAVING MACHINE

[75] Inventor: Bo Lindblom, Älmhult, Sweden

[73] Assignee: Texo AB, Almhult, Sweden

[21] Appl. No.: 347,388

[22] PCT Filed: Jun. 4, 1993

[86] PCT No.: PCT/SE93/00497

§ 371 Date: Dec. 5, 1994

§ 102(e) Date: Dec. 5, 1994

[87] PCT Pub. No.: WO93/25740

PCT Pub. Date: Dec. 23, 1993

[30] Foreign Application Priority Data

Jun. 10, 1992 [SE] Sweden ..... 9201779

[51] Int. Cl.[6] ..... D03C 15/00; D03C 9/06

[52] U.S. Cl. ..... 139/55.1; 139/110

[58] Field of Search ..... 139/55.1, 110, 139/59, 66 R

[56] References Cited

U.S. PATENT DOCUMENTS 4,827,985 5/1989 Sugita et al. ..... 139/110 X 5,170,821 12/1992 Yoshida ..... 139/110 X 5,228,480 7/1993 Tamura ..... 139/55.1

FOREIGN PATENT DOCUMENTS 0 335 811 3/1989 European Pat. Off. .

0 520 540 12/1992 European Pat. Off. .

153342 5/1992 Japan ..... 139/55.1

*Primary Examiner*—Andy Falik

*Attorney, Agent, or Firm*—Pollock, Vande Sande & Priddy

[57] ABSTRACT

In a weaving machine a control unit for controlling the movement of the shaft frames or harnesses creates a feedback function through load cells and AC-servo motors that enables accurate shaft frame adjustment in forming an open shed. The weaving machine includes detecting mechanisms that detect parameters regarding condition the shaft frames. An individual control unit controls each of the shaft frames. The control units adjust the shaft frames in one or more positions to create open and closed sheds in the warp threads to enable the weft threads to be inserted by the shuttles as the warp threads change position. The control units receive feedback data of at least one of the parameters from the detecting mechanisms, such that operation of the control units incorporates the feedback data. Control systems control the control units to create a substantially constant level in the butting edge of the fabric irrespective of the positions of the shaft frames.

18 Claims, 3 Drawing Sheets

DEVICE FOR CONTROLLING OPERATIONS OF SHAFT FRAMES OF A WEAVING MACHINE

FIELD OF THE INVENTION

The present invention relates to a device associated with a weaving machine, in which warp threads lead from warp beams, via shaft frames or harnesses, to feed rollers. Shaft frames or harnesses are controllable for the creation and changing of open and closed sheds to enable weft threads to be inserted by means of shuttles. Also forming part of the weaving machine is a reed, which is arranged so as to operate toward and away from a butting edge. The butting edge or fell represents the edge or fell of the finished fabric and is situated at a distance in front of the feed rollers.

BACKGROUND OF THE INVENTION

Weaving machines in the form of generic-type shaft machines are well known. In such machines, the shaft frames or harnesses are activated individually or in a coordinated manner toward positions for open or closed sheds. When weaving is in progress, warp and weft threads represent a swinging system. During weaving, it is important for the thread tensions to be able to be checked and kept within certain prescribed ranges so that the finished woven product can be produced having the desired quality and characteristics. Various attempts have been made to achieve the necessary control of the various constructional and functional parts of the weaving machine and the various qualities and characteristics of the warp and weft threads. These attempts have been more or less successful.

SUMMARY OF THE INVENTION

Modern development places higher demands upon manufactured products than before. Similarly, weaving machine manufacturers are faced with higher demands regarding the functions of weaving machines. The functions must be able to be performed with greater reliability. Also, the functions must enable simpler operating and handling procedures, faster weaving speeds, long working lives, long service intervals, among other things. In addition, price pressure bears upon product development, production, among other things, and on the actual machine construction. The weaving machine has to be able, among other things, to work with few operating breakdowns and stoppages.

The above means, among other things, that recourse must be taken to a refined control function for functional parts forming part of the weaving machine. The control and functions of the shaft frames or harnesses, among other things, have a critical bearing upon the control over the swinging mass that the thread arrangement in the machine represents. It is important for the race boards in the open sheds to be able to be arranged precisely, despite differences in the quality of the thread material, production variances in the machine, among other things. This means, in turn, that similar shed images have to be able to be established in the various weaving instances and weaving functions. Control systems for the shaft frames or harnesses are of critical importance to the checking of the thread tensions. The object of the present invention is to solve, among other things, these problems.

The warp thread tensions should also be adaptable to the tensions of the weft threads and/or to their wrapping around, or various bindings, to the warp threads. Variations can herewith occur, in dependence upon changes in the pattern.

Individual warp thread tensions should be able to be established for the warp threads in the lower and upper sheds. A uniform quality should be able to be maintained in the fabric/blanket irrespective of whether the weft threads zigzag through every second warp thread or are placed over two or more warp threads before being bound by the subsequent warp thread, and so on. The invention solves these problems.

According to the invention, feedback function(s) working with precision should be arranged for each shaft frame. The control function for the shaft frame or harness should, nevertheless, be able to be arranged individually and/or in coordination with one or more other shaft frames or harnesses. The invention aims to solve this problem also.

Production variances can be present in the weaving machine and its functioning, as well as in the warp and waft thread material, which can also have different qualities. Wear and changes in internal and external conditions in the machine and in the thread material can also constantly occur. Compensations in the control of the shaft frames or harnesses and other components in the machines must, therefore, be continually carried out. The invention also aims to solve these problems.

According to the invention, for the control systems for the shaft frames or harnesses, use should be able to be made of AC-servo motors of a known type, as well as of cylinders, for example, hydraulic cylinders, operating with a feedback function. The control mechanisms should be able to be incorporated into an expedient function containing the above-specified requirements for the weaving machine, the woven product, among other things. The invention also aims to solve these problems.

In weaving in which a large number of shaft frames or harnesses are moving in the same direction (upwards or downwards), measures have to be taken to retain the race boards in essentially the same position. The control systems for the sizes of the shed openings in various weaving phases must also be established in order to produce optimal shed opening positions. In this case, the system should be able to operate, for example, with different-sized upper and lower sheds. The invention solves this problem also.

The proposed control system for the shaft frames or harnesses should be able to be coordinated with other components in the weaving machine that act upon the thread tensions, for example, warp beams, feed rollers, among other things. The invention aims to solve this problem also.

There is a requirement for the machine construction to be more readily adaptable to the wishes of the customer and, for example, for shaft frame or harness machines to be supplied having the number of shaft frames or harnesses requested by the customer. The drive arrangement would have to be adapted, in this case, to the existing number of shaft frames or harnesses. This problem is solved by the invention.

What can primarily be considered to be characteristic of a device according to the invention is that the shaft frames or harnesses are individually controlled by units that carry out the controls and that, upon the adjustment of the respective shaft frame or harness in one or more positions, respectively operate with feedback function(s) giving the shaft frame or harness in question distinct positions during the weaving function. The feedback function incorporates one or more parameters, for example, force, mass, among others, in mechanisms, for example, a load cell, detecting the functions of the shaft frames or harnesses. An additional characteristic is that the control system for any particular one of the units is arranged individually and/or in a coordinated manner so that, for example, when weaving is in progress, the butting edge or fell in the woven material assumes essentially the same level/position irrespective of which mutually pushed-up and pulled-down positions the shaft frames or harnesses assume in the realization of open sheds. Clearly defined race boards are thereby established during the course of the weaving. Alternatively, the invention is characterized in that the warp thread tensions can be adapted to the weft threads' wrapping around, or bindings to, the warp threads.

In one embodiment of the device according to the invention, the control system for the units is arranged so as to produce essentially equal and/or symmetrical shed images for different weaving instances. "Weaving instances" refers to weaving instances for different warp and weft threads. The control system is arranged so as to produce essentially equal and/or symmetrical shed images, also irrespective of differences in production and/or wear in the weaving machine. The control system can be established or supplemented by a so-called neural function, in which continuous teaching of existing and arising peculiarities can be learned. The peculiarities can vary on the basis of the construction of the weaving machine, the wear on the weaving machine, thread characteristics and thread quality, among other things. The acquired learning can be extracted in information that is transferable to the control system for the units. The information in question can actually be supplemented by experience-related or knowledge-based information concerning production variances and wear characteristics of the weaving machine, and the thread characteristics.

In a further embodiment, use is made of AC-servo motors or feed-back-coupled hydraulic cylinders, which respectively act upon the shaft frames or harnesses, via their respective load cell, by means of which signals can be fed back to the AC-servo motors or cylinders in dependence upon the detected parameter, such as load, force, mass, among others, for the shaft frames.

In a preferred embodiment, the individual control system for the shaft frames or harnesses is based upon the fact that essentially the same warp thread tension should be generated during the progression of the weaving, or, in any event during predetermined parts of the weaving. In a joint function in the weaving machine, the above-specified shaft frame or harness control system operates on the fact that the warp beams are arranged movably and with feedback activation function(s), which help to ensure that constant warp thread tension is generated during at least certain parts of the progression of the weaving. In one embodiment, the feed rollers can be constructed with rubber coatings for the establishment of a predetermined clamping around the woven material. The warp beams can also be arranged with AC-servo control for optimized back rest movements. A characteristic is also that adjustment is carried out individually for each shaft frame. The drive arrangement is of modular construction, moreover, so that it can be adapted to a variable number of shaft frames.

As a result of the above-proposed device, the desired functions in the weaving machines are obtained. The shaft frames or harnesses can be controlled individually so that they contribute, with predetermined force, to the action on the warp thread at the opening of the particular shed. A respective shaft frame or harness cannot, therefore, exert a greater force upon the warp thread than other shaft frames or harnesses. This is of critical importance to the provision of clearly defined, symmetrical sheds, which are virtually identical in each different weaving instance. As a result of the above-proposed arrangements for different components of the weaving machine, the butting edge or fell can be kept in a predetermined position in which the shuttles can be allotted their clearly defined race boards. Inappropriate and different frictions between the shuttles and weft threads and warp threads are thereby prevented. The shuttle speeds can be increased and the activation functions for the shuttles can be dimensioned at values that are lower than previously obtainable, by virtue of the fact that the pushing-away forces no longer need to be of a size commensurate with the worst case. A uniform fabric or blanket quality can also be achieved by the fact that the warp thread tensions can be adapted to the weft threads' wrapping around or binding to the warp threads. Adaptation to a variable number of shaft frames or harnesses opens the way to a customer service offering technical and financial advantages to the customer.

BRIEF DESCRIPTION OF THE DRAWINGS

A presently proposed embodiment of a weaving machine exhibiting the characteristics that are indicative of the invention will be described with simultaneous reference to the appended drawings, in which.

DETAILED DESCRIPTION OF THE INVENTION

Figure 1:
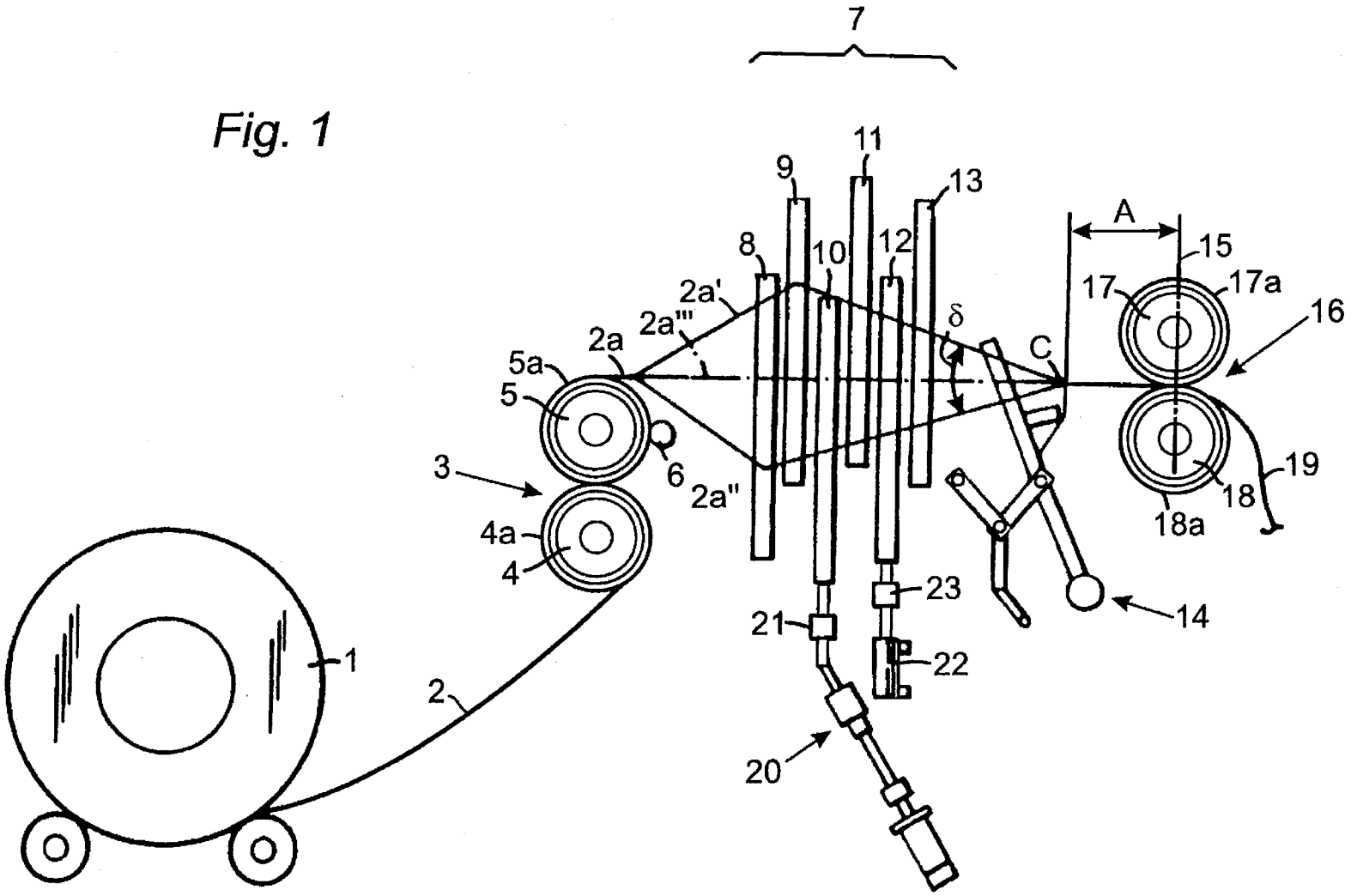
FIG. 1 shows, a side view in basic diagram form, a weaving machine having the construction parts incorporated in the invention.

In FIG. 1, a warp thread beam is denoted by 1; and the warp thread issuing from the magazine is symbolized by 2. A back rest arrangement is indicated by 3. The warp tension rolls or back rests 4, 5 are provided with rubber coatings 4*a* and 5*a* respectively. The back rest arrangement 3 is driven by an AC-servo motor. The arrangement additionally operates with a load cell 6. The load cell 6 forms part of a feedback function with the AC-servo motor. The tension rolls 4, 5 are movably arranged in a known manner. The load cell 6 is incorporated in order to enable predetermined maximum thread tensions in the warp 2*a* issuing from the back rest arrangement.

The outgoing warp 2*a* is led onward through a shaft frame or harness arrangement 7 having a number of individually operating shaft frames or harnesses 8, 9, 10, 11, 12 and 13. The function of the shaft frames or harnesses is to achieve open and closed warp thread sheds. A first bunch of warp threads 2*a*' has been pulled upwards by the frames or harnesses 9, 11 and 13, while a second bunch of warp threads 2*a*" have been pulled downwards by the frames or harnesses 8, 10 and 12. An open shed $\partial$ is present, therefore, in the case shown in FIG. 1. In a subsequent functional stage in the weaving machine, the frames or harnesses shift their vertical-location positions, causing a different shaft frame or harness arrangement to be obtained, and so on. The positions 2*a*''' of the warp threads show the neutral position of the warp threads, that is, in which the shaft frames or harnesses move from a neutral position toward one or another of their two opening positions in which they may be positioned. The edge or fell of the fabric is denoted by C. The weaving machine operates with a reed 14, which operates toward and away from the edge or fell C in a known manner. The edge or fell is situated at a distance A from a center line 15. In the embodiment shown in FIG. 1 the center line is a vertical line through a feed roller arrangement 16 having rollers 17 and 18. The outgoing fabric 19 is fed out via the rollers, which are provided with rubber coatings 17*a* and 18*a*, respectively. The rollers bear against each other at a predetermined pressure that should enable the fabric to be fed out expediently, while simultaneously contributing to an expedient warp thread tension.

In the embodiment shown in FIG. 1, each shaft frame or harness is individually controlled with the aid of an AC-servo motor arrangement 20. The AC-servo motor acts upon its associated shaft frame or harness, via a load cell 21, for the particular positioning of the shaft frame. As a result of the arrangement, a feedback function is obtained that enables a very accurate adjustment of the vertical location of the respective shaft frame or harness in its respective end location. Using the load cell, the force acting upon the shaft frame or harness can be determined with a very high degree of accuracy. By jointly controlling the units 20, 21 for the different shaft frames or harnesses, the respective open shed $\partial$ is very accurately set. Each shaft frame or harness will contribute a lift-up or pull-down position for the warp thread that is coordinated with lift-up or pull-down functions of other shaft frames or harnesses. No shaft frame or harness will, therefore, load or press against the warp thread in an inappropriate manner. The shaft frames or harnesses, which can thereby be allotted exact and mutually different pull-up or pull-down locations, will thus contribute to the establishment of an accurate shed, which can be symmetrical.

In an alternative embodiment, the AC-servo motor arrangement can be replaced by a hydraulic cylinder 22, which operates in an equivalent manner and which acts upon its associated shaft frame or harness via a load cell 23.

Figure 2:
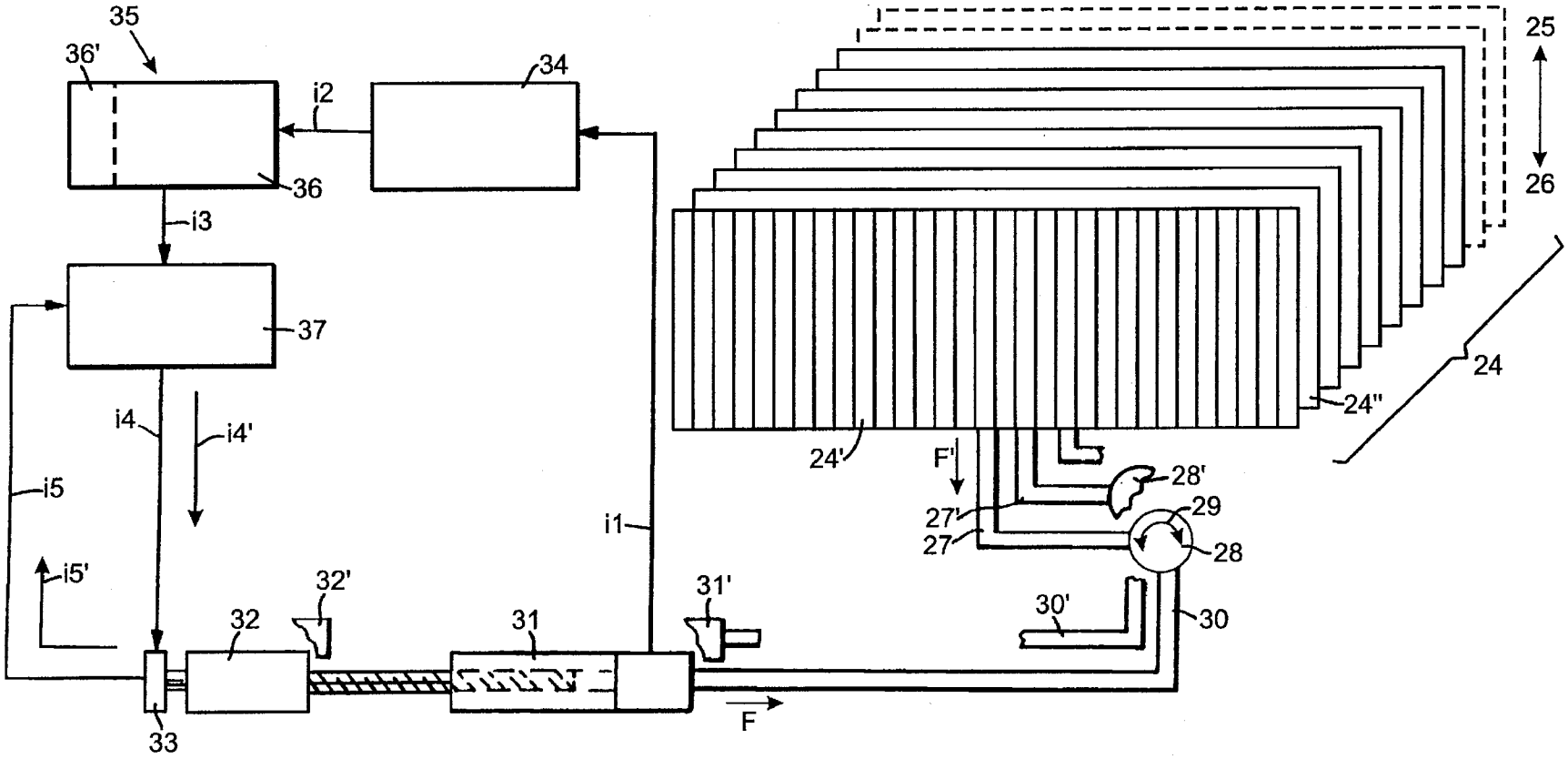
FIG. 2 shows, a partial perspective side view in basic diagram form, the control system for shaft frames or harnesses, by means of which frames or harnesses the control of the warp thread tension is detected and determined.

FIG. 2 shows a more detailed example of an individual control system for the shaft frames or harnesses in a shaft frame or harness arrangement 24 in a known dobby, for example, of the TEXO, SE make. Each shaft frame or harness is individually mounted and can be activated for vertical displacement upwards and downwards in the directions of the arrows 25 and 26, respectively. Each shaft frame or harness is allotted a lever arm 27. The lever arms form part of a lever system together with a swivel link 28. The swivel link is rotatable in directions indicated by the arrow 29. An additional lever arm 30 is also part of the lever system. The additional lever arm 30 brings about the rotation of the swivel link by a known type of load cell 31, for example, a NOBEL ELECTRONIK load cell. The load cell can be activated, in turn, by means of an AC-servo 32. An example of such an AC servo is an alternating-current servo motor, such as a SEIDEL AC-servo. The described activation system is allotted to the shaft frame or harness 24' in the arrangement 24. Other shaft frames or harnesses have identically similar activation systems. The system 27', 28', 30', 31' and 32' is suggested for the frame or harness 24".

The AC-servo includes a pulse transmitter 33, which indicates the number of rotated turns of the servo. The load cell 31, just like load cells 31', and so on, of the other shaft frames or harnesses, is connected to a force detector or force analyzer 34. The force detector or analyzer detects or analyzes the force F effectuated via the respective load cell to the respective associated lever system 27, 28, 30. Also forming part of the control arrangement 35 is a computer unit 36. The computer unit can be constituted by a known computer and consists, for example, of a microcomputer with an associated memory arrangement 36'. Signal representations of the effectuated load cell forces F received by the force analyzer 34 from the load cells 31, 31', and so on, are indicated by il. The force analyzer processes the information il and, in dependence upon the processing, emits signals i2 to the computer 36. The computer, in dependence upon the signals i2, in turn, generates signals i3 to a positioning unit 37. The latter unit, in dependence upon the data signals i3, generates target-value signals i4, i4' to the AC-servos 32. The signals, via pulse transmitters 33, are fed back to the positioning unit 37. The feedback signals are indicated by i5, i5'. The feedback function has the effect of making the AC-servo adjust itself to the stipulated target-value.

The control systems for the shaft frames or harnesses may include the load cell 31, AC-servo 32, pulse transmitter 33, force analyzer 34, computer 36, and positioning unit 37.

A shaft frame or harness can be activated, via a lever system and/or linkage, by a power supply and force measuring arrangement that is controlled by the computer and positioning unit for the power supply arrangement and a force detection and/or force analyzing unit. Upon the position of the shaft frame being fixed in a parameter, for example, the thread tensions, that cannot be influenced in the weaving machine by the shaft frame or harness, the shaft frame or harness can be further activated, after the fixing of the position, by virtue of the force detection and possible processing of the force detection by the force measuring and/or force analyzing system and by guidance provoked thereby from the computer of the power supply arrangement.

The power supply and force measuring arrangement form a modular unit. Additionally, the control unit forms a basic module. The basic module operates a plurality of modular units. The number of modular units operated by the basic module depends upon, for example, the number of shaft frames or harnesses in the weaving machine.

The computer unit 36 operates in each weaving instance with a program devised for the weaving instance. The computer generates, with the aid of the program, control signals i3 to the positioning unit 37. The AC-servo(s) is/are primed, in turn, to the target-value signals i4, i4' generated by the positioning unit. The AC-servo(s) act(s), via its/their load cells, upon the lever system with a mechanical path. The mechanical path is dependent upon the positioning signals, and, thereby, cause(s) the lever system to act upon the shaft arrangement in such a way that some of the shaft frames or harnesses move upwardly and some move downwardly, depending upon the weaving instance. In each respective lever arrangement, a counter-force F' is hereby generated. The size of the counter-force is dependent upon that particular parameter in the weaving system that can be influenced. In this case, the side is dependent upon the thread tensions in the warp threads of the particular shaft frame. The force F' is balanced out by the force F, which is effectuated by the load cell and which is detectable in the force analyzer 34 by virtue of the signal il generated by the force F. The force analyzer or force detector 34 thereafter transmits the processed or detected finding to the computer. The computer, by virtue of its programming, determines whether any one or more of the shaft frames or harnesses in the shaft frame or harness arrangement should have altered or renewed target-values i4, i4'. If this is the case, then the AC-servo is primed to altered or renewed target-values and the respective force F increased. The increased force F gives rise to a corresponding increase in the force F', and so on. In this way, an individualized checking and control of the warp thread tensions is continually conducted during the various weaving machine phases. The calculation in the force analyzer can include mutual relative settings of the various force cell signals.

Figure 3:
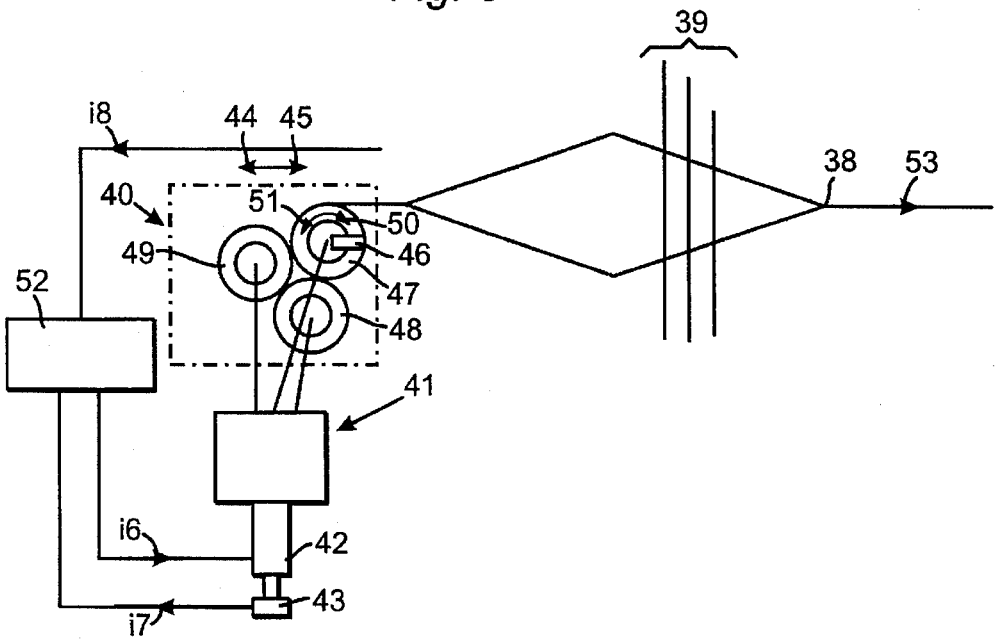
FIG. 3 shows, a side view in basic diagram form, positions of a back rest arrangement determined in dependence upon the warp thread tensions.

In FIG. 3, the butting edge or fell is indicated by 38, a part of the shaft frame or harness arrangement by 39 and a warp beam system by 40. The back rest system is driven via a gearbox arrangement 41, which is controlled, in turn, by an AC-servo arrangement (compare to the embodiment described above). In the AC servo arrangement shown in FIG. 3, an AC-servo has been indicated by 42 and its pulse transmitter by 43. The AC-servo can be of the SEIDEL make. The back rest arrangement 40 is preferably spring-mounted so that it is able to execute movements in the directions of the arrows 44 and 45. In FIG. 3, directions 44 and 45 coincide with the longitudinal directions of the shed and of the free warp thread parts.

One or more load cells 46 are arranged in one or more spring-mountings for one or more back rests or rolls 47, 48 and 49. The rotation speeds of the back rests and possibly different rotational directions 50 and 51, for the back rest or roll 47, and corresponding direction for the back rests or rolls 48 and 49, can be determined using the AC servo 42, which, in each stipulation phase, operates with feedback signals. The target-value signal(s) is/are in this case denoted by i6 and the feedback signal(s) by i7. The respective adjustment gives rise to actual-value signals i8, produced by the load cell(s), for the current thread tension in the warp thread arrangement/warp thread arrangement part. The actual-value signals i8 vary continuously during the function phases of the weaving machine and must be constantly counter-regulated by action on the rotations/directions of the back rest arrangement. The controls are carried out with a computer unit 52, in a known manner using conventional software. The computer unit 52 can be of the same type as the computer unit 37. Alternatively, the two computer units can be replaced by a common computer unit.

The variable rotations and possibly reversed rotational directions 50, 51 in the back rest or roll system are determined by means of the computer 52. The rotational directions are determined simultaneously with the feeding of warp thread during the course of the weaving, at a certain speed, in the direction of the arrow 53. The load cell in question will sense the force upon the threads. When the shed closes, the rollers will reverse and/or rotate backwards in order to keep the thread tension constant. This system feeds a little more forwards than backwards, since the back rests or rolls convey a certain quantity of fabric forwards for each weft thread.

Figure 4:
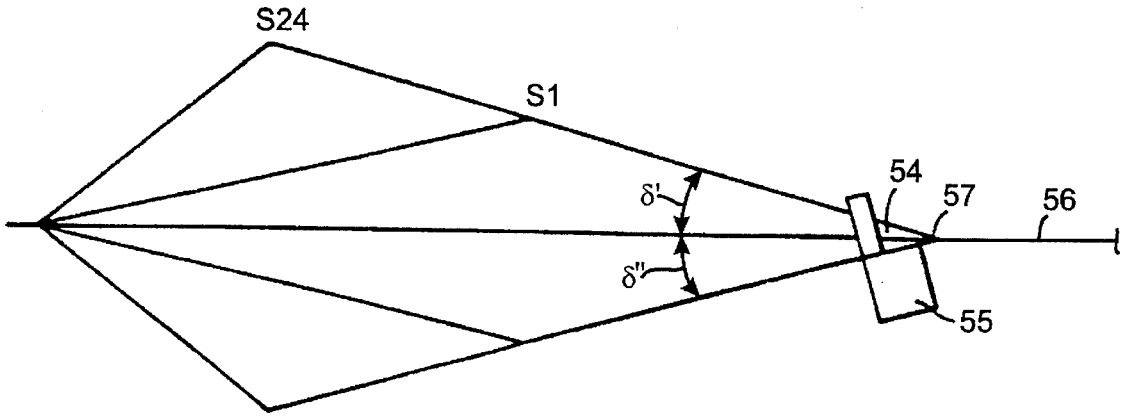
FIG. 4 shows, a side view in basic diagram form, the shaft frame or harness positioning according to one particular case.

FIG. 4 shows examples of situations in the weaving phases in which an expedient adjustment of the warp thread tensions can be made during the course of the weaving. The shuttles are indicated by 54 and the shuttle box arrangement by 55. The outgoing weave is indicated by 56 and the outer shaft frames or harnesses in the shaft frame or harness arrangement by S1 and S24, in other words, the total number of shaft frames or harnesses is 24. The shaft frame or harness S24 can be assumed to overstretch the thread. In order to prevent a lower tension than shaft frame or harness 1 when reed 14 impacts the edge or fell C of the fabric formed by the weaving machine, a calculation is made in the force analyzer 34 to determine the extent to which the shed should be closed. For example, the shaft frame or harness 1 can be located in the middle, the shaft frame or harness 2 should be open 1% up to the shaft frame or harness 24, which should be 23% opened. This information is forwarded to the computer, which determines the position to be transmitted to the positioning unit 37. If the shuttle is pushed through the shed and a plurality of shaft frames or harnesses are activated in the upward or downward direction, the edge or fell 57 of the cloth will travel upwardly or downwardly, which causes the lower shed threads to accompany this movement. The passage of the shuttle is thereby obstructed. In order to counteract this, the upper shed is opened, for example, only 80% instead of the 100% when fully opened. The position of the butting edge or fell 57 can thus be controlled by the fact that the system is able to operate with differently sized upper and lower sheds $\partial$ and $\partial'$, respectively.

The invention can be applied to weaving machines for large fabric widths, viz. 10–30 meters, and weaving speeds of up to 100 picks per min. The forces F generated on the frames or harnesses can assume values of up to 4500 Newton×24 (shaft frames or harnesses).

The activation system using the drive source comprises a basic module including the aforementioned elements 34, 35, 37 and executive modules including the aforementioned elements 31, 32, which, via allotted linkage systems 27, 28, 30 or equivalent, are selected in dependence upon the number of shaft frames or harnesses, that is, one executive module for each shaft frame or harness.

The invention is not limited to the embodiment shown by way of example above, but can be subject to modifications within the scope of the subsequent patent claims and the inventive concept.

I claim:

1. A weaving machine comprising:

tension rolls for guiding and adjusting a tension of warp thread in said weaving machine;

shaft frames for positioning the warp thread for weaving;

feed rollers for feeding out of said weaving machine a fabric produced by said weaving machine;

shuttles for inserting weft threads between warp threads;

a reed operating toward and away from a butting edge of the fabric situated in front of the feed rollers, said reed moving weft threads toward said butting edge;

detecting mechanisms for detecting parameters regarding said shaft frames, said parameters representing feedback data;

an individual control unit for each of said shaft frames, said control units adjusting said shaft frames in one or more positions to create open and closed sheds in the warp threads to enable the weft threads to be inserted by said shuttles as the warp threads change position, said control units receiving the feedback data of at least one of said parameters from said detecting mechanisms, such that operation of said control units incorporates said feedback data; and control systems for controlling said control units via linkage systems to create a substantially constant level in the butting edge of the fabric irrespective of the positions of the shaft frames.

2. A weaving machine according to claim 1, further comprising means for said control systems to control said control units individually.

3. A weaving machine according to claim 1, wherein said control systems include means for controlling said control units so as to establish clearly defined race boards during weaving of the fabric.

4. A weaving machine according to claim 1, wherein said mechanisms include a load cell for detecting movements of the shaft frames.

5. A weaving machine according to claim 1, wherein said detected parameters regarding said shaft frames include at least one member selected from the group consisting of force and mass.

6. A weaving machine according to claim 1, further comprising means for said control systems to control said control units to produce essentially equal shed images.

7. A weaving machine according to claim 1, further comprising means for said control systems to control said control units to produce shed images with differently sized upper and lower sheds.

8. A weaving machine according to claim 1, wherein each of said control units comprises an AC-servo motor and a load cell, wherein said AC-servo motors act upon said shaft frames via said load cells, wherein said control units send feedback signals to said AC-servo motors in dependence upon a load, a force, and a mass detected on said shaft frames.

9. A weaving machine according to claim 1, wherein each of said control units comprises a hydraulic cylinder and a load cell, wherein said hydraulic cylinders act upon said shaft frames via said load cells, and wherein said control units send feedback signals to said hydraulic cylinders in dependence upon a load, a force, and a mass detected by said shaft frames.

10. A weaving machine according to claim 1, further comprising means for said control units to control said shaft frames to obtain essentially a same warp thread tension during at least a portion of the weaving process.

11. A weaving machine according to claim 1, further comprising means for making said tension rolls movably arrangable, wherein the movability of said tension rolls provides means for said control units to control said shaft frames.

12. A weaving machine according to claim 1, further comprising means for operating said tension rolls at variable rotation speeds, wherein the variability of said rotation speeds of said tension rolls provides means for said control units to control said shaft frames.

13. A weaving machine according to claim 1, further comprising means for varying the rotational directions of said tension rolls wherein the variability of rotational direction of said tension rolls provides means for said control units to control said shaft frames.

14. A weaving machine according to claim 1, further comprising:

lever systems or linkages interconnected with said shaft frames for activating said shaft frames;

a power supply interconnected with and for providing power to said lever systems or linkages;

a force detection and analyzing unit interconnected with at least one of said shaft frames for measuring force on said shaft frames;

a computer and positioning unit interconnected with and for controlling and positioning said force detecting and analyzing unit;

a positioning unit interconnected with and for positioning said power supply; and wherein upon fixing a position of a shaft frame, said shaft frame can be further activated after the force detection and analyzing unit detects a force on said shaft frame and sends a signal to said computer and positioning unit, and said computer and positioning unit guides the further activation of said shaft frame.

15. A weaving machine according to claim 14, wherein said power supply and said force detecting and analyzing unit form a modular unit, and said control units form a basic module operating a plurality of said modular units, the number of said modular units depends upon the number of shaft frames in the weaving machine.

16. A weaving machine according to claim 1, wherein the control system includes means for causing said shaft frames to open an upper shed in said warp threads to a reduced extent when a large number of shaft frames move in one direction as compared to when a small number of said shaft frames move in one direction.

17. A weaving machine according to claim 16, wherein said reduced extent comprises 80% of a fully opened shed.

18. A device for a weaving machine, the weaving machine including tension rolls for guiding and adjusting a tension of warp thread in the weaving machine, shaft frames for positioning the warp thread for weaving, feed rollers for feeding out of the weaving machine a fabric produced by the weaving machine, shuttles for inserting weft threads between warp threads, a reed operating toward and away from a butting edge of the fabric situated in front of the feed rollers, the reed moving weft threads toward the butting edge, said device comprising:

detecting mechanisms adapted for detecting parameters regarding the shaft frames, said parameters representing feedback data;

an individual control unit for each of said shaft frames, said control units adjusting said shaft frames in one or more positions to create open and closed sheds in the warp threads to enable the weft threads to be inserted by said shuttles as the warp threads change position, said control units receiving feedback data of at least one of said parameters from said detecting mechanisms, such that operation of said control units incorporates said feedback data; and control systems for controlling said control units via linkage systems to create a substantially constant level in the butting edge of the fabric irrespective of the positions of the shaft frames.

* * * * *